US008673189B2

(12) United States Patent
Schwoerer

(10) Patent No.: US 8,673,189 B2
(45) Date of Patent: Mar. 18, 2014

(54) METHOD FOR IMPLEMENTING A RAIL-GUIDED SELF-CLIMBING FORMWORK SYSTEM WITH CLIMBING RAIL EXTENSION PIECES

(71) Applicants: Reinhold Holzmueller, Stuttgart (DE)
Peri GmbH, Weissenhorn (DE)

(72) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 13/677,337

(22) Filed: Nov. 15, 2012

(65) Prior Publication Data

US 2013/0318888 A1 Dec. 5, 2013

Related U.S. Application Data

(63) Continuation of application No. 12/736,221, filed as application No. PCT/DE2009/000380 on Mar. 21, 2009, now abandoned.

(51) Int. Cl.
*E04G 21/00* (2006.01)
*E04G 11/28* (2006.01)

(52) U.S. Cl.
CPC ..... *E04G 21/00* (2013.01); *E04G 11/28* (2013.01)
USPC ..... 264/33; 249/20; 425/65

(58) Field of Classification Search
USPC ..... 264/31, 33, 34; 52/745.09; 425/63, 64, 425/65; 249/19, 20, 21, 22
See application file for complete search history.

(56) References Cited

U.S. PATENT DOCUMENTS

| | | | | | |
|---|---|---|---|---|---|
| 2,118,374 | A | * | 5/1938 | Doyle | 425/65 |
| 3,071,837 | A | * | 1/1963 | Cerutti | 249/10 |
| 3,472,477 | A | * | 10/1969 | Juhl | 249/219.1 |
| 4,040,774 | A | * | 8/1977 | Scheller | 425/65 |
| 4,374,634 | A | * | 2/1983 | Ahl | 425/65 |
| 4,397,441 | A | * | 8/1983 | Manderla | 249/19 |
| 4,611,784 | A | * | 9/1986 | Gallis | 249/20 |
| 2009/0173574 | A1 | | 7/2009 | Hobmeier | |

FOREIGN PATENT DOCUMENTS

| | | | | |
|---|---|---|---|---|
| CN | 1037184 | | 11/1989 | |
| DE | 3842092 | * | 6/1990 | E04G 11/28 |
| DE | 10 2007 018 853 | | 10/2008 | |
| FR | 2 298 662 | | 8/1976 | |
| FR | 2487410 | * | 1/1982 | E04G 11/28 |

(Continued)

OTHER PUBLICATIONS

Peri GmbH, aktuell-special edition for bauma trade fair 2007, Weissenhorn, Germany, Apr. 2007.

(Continued)

*Primary Examiner* — Michael Safavi
(74) *Attorney, Agent, or Firm* — Paul Vincent

(57) ABSTRACT

A method is proposed for constructing multi-story concrete structures using a rail-guided self-climbing formwork system. A climbing rail is thereby displaced in a vertical direction within lower and upper climbing shoes and a lower extension piece is positioned to extend vertically in a downward direction below a lower end of the climbing rail. The lower extension piece has a length which is less than the length of the climbing rail. The climbing rail is then displaced in the vertical direction until the lower extension piece is captured within the lower climbing shoe. The method simplifies construction of the lower stories of concrete structures.

11 Claims, 6 Drawing Sheets

(56) References Cited

FOREIGN PATENT DOCUMENTS

| | | | | |
|---|---|---|---|---|
| JP | 59-136844 | | 9/1984 | |
| JP | 08-144514 | | 6/1996 | |
| JP | 2008-545072 | | 12/2008 | |
| JP | 2008-545074 | | 12/2008 | |
| JP | 2008-546937 | | 12/2008 | |
| KR | 20-0423750 | * | 11/2006 | ..... E04G 3/28 |
| SU | 850846 | * | 7/1981 | ..... E04G 11/28 |
| WO | WO 2007/000134 | * | 1/2007 | ..... E04G 11/28 |
| WO | WO 2007/000136 | * | 1/2007 | ..... E04G 11/28 |
| WO | WO 2007/000137 | * | 1/2007 | ..... E04G 11/28 |
| WO | WO 2007/000139 | * | 1/2007 | ..... E04G 11/28 |

OTHER PUBLICATIONS

Peri Kletterschalung KG 180 and KGF 240, Weissenhorn, Germany, Jun. 1976.

* cited by examiner

METHOD FOR IMPLEMENTING A RAIL-GUIDED SELF-CLIMBING FORMWORK SYSTEM WITH CLIMBING RAIL EXTENSION PIECES

This is a continuation of Ser. No. 12/736,221 filed on Jan. 18, 2011 as the national stage of PCT/DE2009/000380 filed on Mar. 21, 2009 and also claims Paris Convention priority of DE 10 2008 015 682.5 filed on Mar. 25, 2008, the entire disclosures of which are hereby incorporated by reference.

BACKGROUND OF THE INVENTION

The invention relates to a rail-guided self-climbing formwork system in the building sector, with climbing rails guided in climbing shoes that are integrated into a scaffold unit, wherein the climbing shoes can be attached to a hardened concrete section and concrete sections, respectively, and the climbing rails are moveable, guided and held in the climbing shoes.

Such self-climbing formwork systems have become known through international patent applications WO 2007/000139 A1, WO 2007/00136 A1, WO 2007/000134 A1 and WO 2007/000137 A1.

In the known rail-guided self-climbing formwork systems at least two floors or concrete sections must be constructed with known formwork systems before the known self-climbing formwork can be used. This is necessary because the climbing rails used are guided, held and moved in climbing shoes which are attached to various concrete sections.

To move the climbing shoes from one concrete section to another concrete section a large-area scaffold unit is additionally required so that the individual working processes necessary for a climbing procedure can be carried out without the use of a crane.

As known, for example, from WO 2007/000139 A, due to the length of the climbing rails a sufficient structural height must be reached when using the self-climbing formwork system so that the lower free ends of the climbing rails do not collide with the ground on which the first concrete section is erected, or a floor ceiling which may have been built underneath the first concrete section. Normally, two floors have to be completed initially in order to be able to use the self-climbing formwork system. The length of the climbing rails is thus determined by the height of the concrete sections, respectively, to be built and the required presence of a finishing platform in the case of higher concrete sections. The length of the climbing rails is therefore much greater than the height of the concrete section to be constructed.

FR 2487410 describes a rail-guided climbing formwork system attached to a concrete section, in which climbing rails guided in climbing shoes are integrated into a scaffold unit. In each case one climbing rail is guided in two of the climbing shoes. The climbing rails are of a length that substantially equals the height of the concrete section. The climbing procedure of the climbing formwork system takes place based on climbing cylinders mounted on climbing shoes located higher up. The climbing procedure can only take place after concreting of a complete second concrete section.

The aim of the invention is to simplify the known rail-guided self-climbing formwork system in such a way that it can be used in a broader area of application.

SUMMARY OF THE INVENTION

This aim is achieved by the subject-matters of the claims. The dependent claims represent preferred embodiments of the subject-matter of the invention.

Climbing rail extension pieces, which are shorter in length than the climbing rails, can be attached to the free ends of the climbing rails.

With an embodiment of the climbing rail of this type it is possible to carrying out the climbing procedure with shorter climbing rails, without incurring an increased safety risk. For a safe self-climbing procedure, the at least two parallel climbing rails, arranged at a distance from each other, must always be held each in at least two climbing shoes arranged on top of each other, and during the climbing procedure itself the climbing rails must, via climbing rail extension pieces attached to them, be further moved into a further third climbing shoe pair and held there before the first of the three pairs of climbing shoes arranged on top of the other is removed, in order, for example, to use this pair again as fourth climbing shoes above the third climbing shoes. For this climbing procedure the climbing rail in question must have a minimum length that is significantly greater than a floor height to be concreted. By using climbing rail extension pieces the climbing rails proper can be shortened so much that their total length does no longer project beyond a concrete section to constructed, i.e. the climbing rails have a length that substantially equals the height of the hardened concrete section on which the climbing rails are attached via climbing shoes.

This means that a shortened climbing rail and pair of climbing rails, respectively, in accordance with the invention can already be used after completion of a first floor or a first concrete section. For a further climbing procedure after the completion of the second concrete section, the at least two climbing rail extension pieces are rigidly connected to the free upper ends of the climbing rails, so that during a climbing procedure the climbing rails can be introduced into climbing shoes which have been attached to the most recently constructed and hardened concrete section. At the same time the climbing rail(s) is/are still held in two climbing shoes arranged underneath so that the climbing procedure can take place while ample safety is provided.

For a new concreting procedure, climbing rail extension pieces are then removed again from the upper end of the climbing rails if the climbing rails are held guided in two pairs of climbing shoes attached on top of each other. With these measures a rail-guided self-climbing formwork system can be used which during a concreting procedure does no longer project with its climbing rails beyond a concrete section or completed floor. The climbing rails have a length which is substantially equal to the height of a concrete section to be concreted or is shorter, respectively, than the height of concrete section to be constructed.

At least on the lower free ends of the climbing rails, climbing rail extension pieces, that are shorter in length than the climbing rails, can be attached in a detachable and/or pivoting manner.

The inventive self-climbing formwork system can already be used after completion of a first concrete section. For this, the climbing rail extension pieces are initially detached from the lower free ends of the climbing rails or attached thereto in a pivoted manner. The climbing rails have to chosen to be so short that they are essentially of a length corresponding to the height of the concrete section. The lower free ends of the climbing rails then do no longer collide with the ground on which the first concrete section is constructed or a floor ceiling which may be constructed below the first concrete section. Once a sufficient floor height has been reached, the climbing rail extension pieces are detachably and/or pivotably attached to the lower free ends of the climbing rails so that, for example, a finishing platform can be provided on it.

In a further embodiment of the invention the climbing rail extension pieces are shorter than the height of a concrete section to be constructed. On the one hand, a desired manageability is thus achieved, and on the other hand, through the length of the climbing rail extension pieces, it is ensured that in each climbing procedure the thus extended climbing rail safely reaches the next climbing shoe and can be held there. In connection with this, the length of the climbing rail extension pieces is preferably greater or equal to half the distance between two climbing shoes arranged directly on top of each other.

If the climbing rail extension pieces are connected to the free ends of the climbing rails by means of locking pins, with simple structural means a rigid connection between the free ends of the climbing rails and the climbing rail extension pieces can be produced. At the same time a connection of this type can be rapidly and simply detached again, as after each completed climbing procedure the climbing rail extension pieces have to be removed from the climbing rails again, so that the external formwork and/or the internal formwork can be brought into a position in which the new concrete section is to be constructed.

It is advantageous if each climbing rail extension piece can be connected by means of two locking pins to a free end of the climbing rail. On the one hand, with this measure an articulated connection can be produced if only one locking pin is used, and if two locking pins, at a distance from each other, are used to connect a climbing rail with a climbing rail extension piece, a rigid connection is achieved between the climbing rail and the climbing rail extension piece.

A simplified structure of the rail-guided self-climbing formwork system according to the invention is assured if the climbing rails as well as the climbing rail extension pieces are assembled of two profile rails, which are held together at a distance from each other by means of supporting pins and, as the case may be, spacers, connecting pins. This has the advantage that climbing rail extension pieces can be simply coupled to climbing rails designed in this way, and at the same time the arrangement envisaged in the climbing rail can be continued without interruption in a climbing rail extension piece by a sequence of supporting pins.

The rail-guided self-climbing formwork system has a scaffold unit on which a working platform and a finishing platform are formed. The climbing rails are integrated into the scaffold unit. In conjunction with the shortened climbing rails in accordance with the invention, it is sufficient for the scaffold unit only to have one working platform and one finishing platform. An intermediate platform, as in the prior art, can be dispensed with in the embodiment of the self-climbing formwork system according to the invention. This considerably simplifies the entire rail-guided system.

Advantageously, a moveable external or internal formwork is envisaged on the working platform. If necessary, the said external or internal formwork can be moved on the working platform in such a way that on the one hand climbing shoes can be most easily attached to, or removed from, a hardened concrete section, on the working platform, and on the other hand, the external or internal formwork can be moved into a position on the working platform in which a further concrete section can be constructed.

Climbing cylinders can be mounted on the climbing shoes so that with the aid of these climbing cylinders the entire scaffold unit can be pushed upwards on completed concrete sections, or even pushed downwards, if required. Once a climbing procedure has been completed, the climbing cylinders can be removed from the climbing shoes and mounted onto climbing shoes again in a higher or lower position. The mounted climbing cylinders each engage, via a catch formed on the free end of a climbing cylinder, into supporting pins of the climbing rails and the climbing rail extension pieces, respectively. If the climbing cylinders are moved-out, the climbing rails with the climbing rail extension pieces are moved together with the entire scaffold unit.

In accordance with the invention, in a preferred embodiment of the invention, components of a finishing platform are provided on the lower free ends of the climbing rail extension pieces, which with the other opposite ends are connected in an articulated manner with the lower free ends of the climbing rails. This has the advantage that a finishing platform can be mounted onto the scaffold unit even on the first concrete section. If the climbing procedure is initiated on the first concrete section, the finishing platform is still suspended on the base on which the first concrete section has been erected and as the climbing procedure progresses the climbing rail extension pieces with the components of the finishing platform attached thereto pivot to the completed first concrete section and the finishing platform aligns itself.

Further advantages may be gathered from the description of the attached drawing. Equally, according to the invention the features cited above and further indicated features can each be used individually or in any combination with each other. The mentioned embodiments should not be considered as an exhaustive enumeration, but as examples. The invention is shown in the drawings and is explained in more detail on the basis of examples of the embodiment in the drawings.

DESCRIPTION OF THE PREFERRED EMBODIMENT

Figure 1:
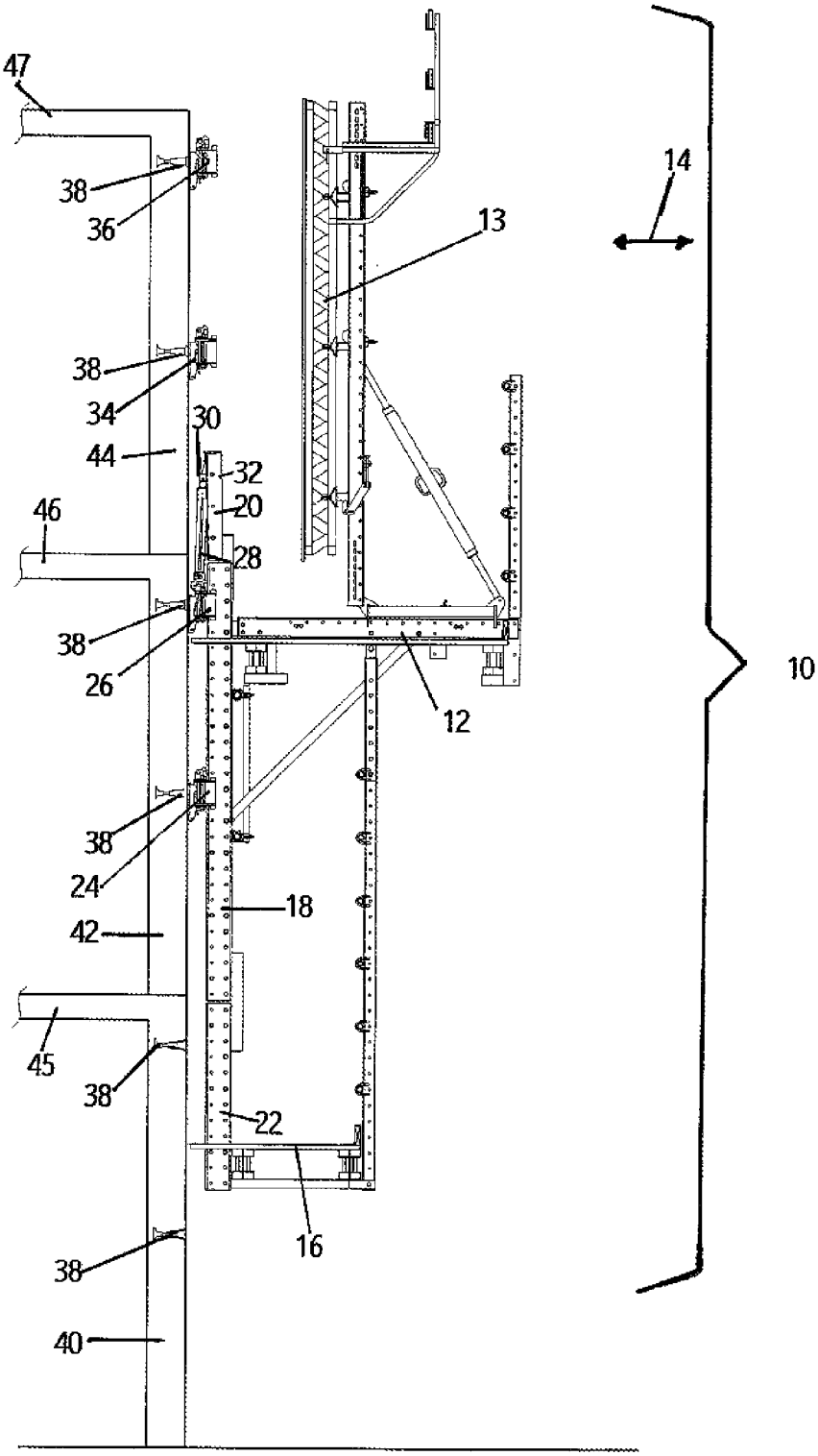
FIG. 1 shows a side view of a rail-guided self-climbing formwork system, bearing an external formwork on a working platform, which can be displaced alongside of concrete sections with the aid of the rail-guided self-climbing formwork system.

In the Figures of the drawing the rail-guided self-climbing formwork system is shown in a strongly schematic manner and the individual feature groups should not be taken as being to scale.

In FIG. 1, 10 denotes a rail-guided self-climbing formwork system which, on a scaffold unit has a working platform 12 on which an external formwork 13 is erected. The external formwork 13 can be moved on the working platform 12 in the direction of the arrow 14. A finishing platform 16 is also integrated into the scaffold unit and, like the working platform 12, is attached to a climbing rail 18. Only a side view of the rail-guided self-climbing formwork system 10 is shown in the Figure which hides a further climbing rail 18, which runs parallel to the shown climbing rail 18 and at a distance from climbing rail 18. In this way the scaffold unit is held together by means of climbing rails 18 (prior art).

Mounted on the upper free end of climbing rail 18 is a first climbing rail extension piece 20 and on the lower free end of climbing rail 18 a second climbing rail extension piece 22 is attached. The climbing rail 18 is guided and held in a moveable manner in climbing shoes 24, 26. Mounted on the climbing shoe 26 is a climbing cylinder 28, which on its free end has a catch 30, which engages below a supporting pin 32 of the first climbing rail extension piece 20. Supporting pins 32 are arranged along the first climbing rail extension piece 20 and along the second climbing rail extension piece 22 and along the climbing rail 18 at predetermined intervals. The climbing shoes 24, 26 also have prior known catches which engage below the supporting pins 32 and can hold the climbing rails 18 and the climbing rail extension pieces 20, respectively, in position. The entire rail-guided self-climbing formwork system is held in the climbing shoes 24, 26 by means of catches on which corresponding supporting pins 32 of the climbing rail 18 or the climbing rail extension piece 20 is suspended.

Climbing shoes 34, 36 are attached to the concrete section via anchoring points 38. In the Figure, a first concrete section 40, a second concrete section 42 and a third concrete section 44 are shown. These concrete sections 40, 42, 44 are hardened and can bear the load of a rail-guided self-climbing formwork system 10. In the concrete sections 40, 42, 44 anchoring points 38 are provided via which the climbing shoes for the rail-guided self-climbing formwork system 10 can be attached. In the Figure, ceiling sections 45, 46, 47 are also suggested, which delimit the respective concrete sections on one side. It is understood that to produce a concrete section 40, 42, 44 each, an internal formwork corresponding to the external formwork 13 shown in the Figure is erected. The ceiling sections 45, 46, 47 are produced by means of known ceiling formwork systems which are not shown in the Figure.

Figure 2:
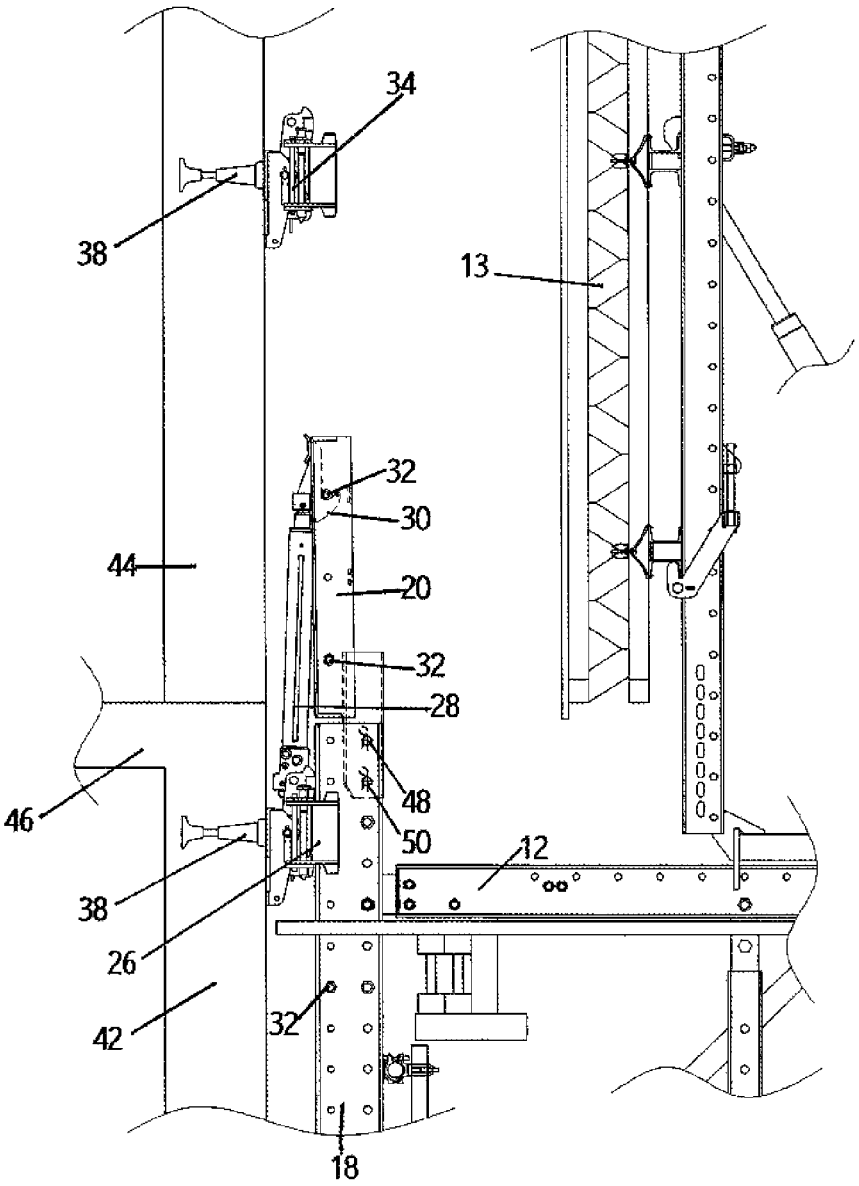
FIG. 2 shows an enlarged side view of components of FIG. 1.

FIG. 2 shows an enlarged side view of details of the second concrete section 42 and the third concrete section 44 of FIG. 1. The ceiling section 46 is suggested. Climbing shoes 26 and 34 are attached in the anchoring points 38 of the second and third concrete sections 42, 44. Mounted in a known manner on the climbing shoe 26 is a climbing cylinder 28 which by means of catch 30 engages below a supporting pin 32 of the first climbing rail extension section 20. Along the first climbing rail extension piece 20 and along the climbing rail 18 supporting pins 32 are provided which can all be arranged from below by catches in the climbing shoes 26 and 38.

By way of a connecting piece 48 the first climbing rail extension piece 20 is pushed into the free end of the climbing rail 18 and by means of locking pins 50 the first climbing rail extension piece 20 is rigidly connected to the climbing rail 18.

The climbing rail 18 also carries the working platform 12 on which the external formwork 13 is attached in a moveable manner.

Figure 3:
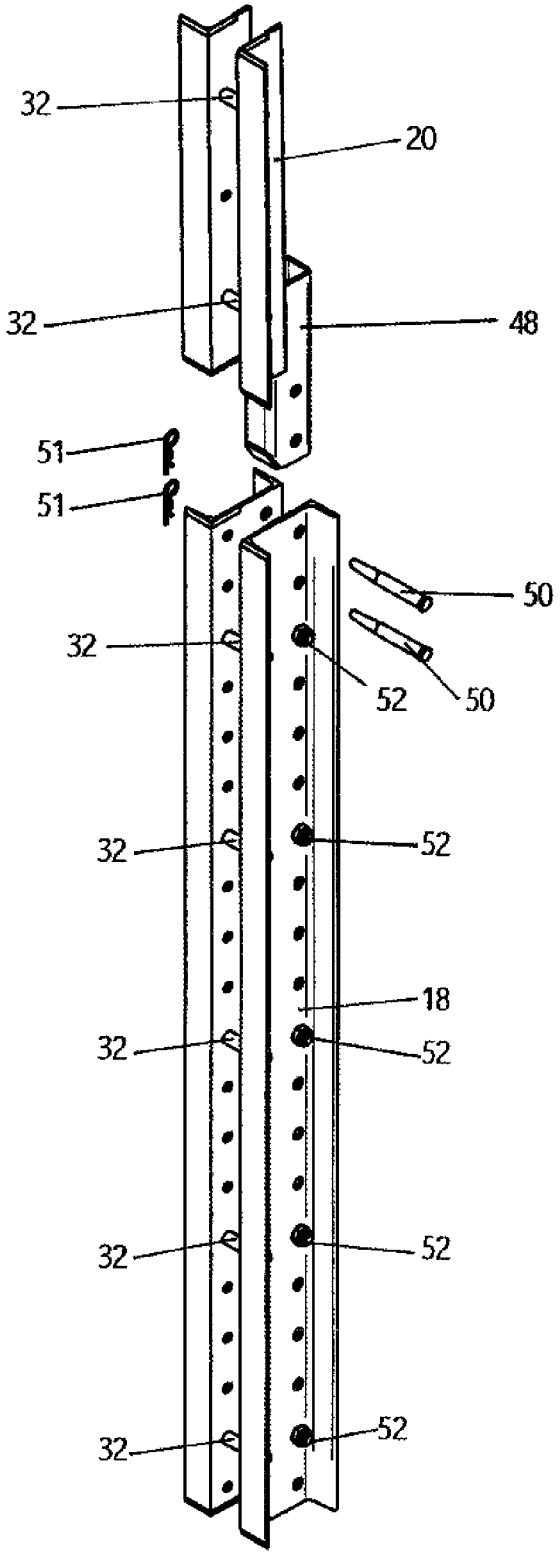
FIG. 3 shows a three-dimensional view of a climbing rail and a climbing rail extension piece and the mode of assembly thereof.

FIG. 3 shows a three-dimensional view of the climbing rail 18 and a first climbing-rail extension piece 20 as used in the rail-guided self-climbing formwork system 10. The climbing rail 18 is made up of two U-profiles. Supporting pins 32 hold the U-profiles together on one side. The length of the supporting pins 32 also determines the distance between the two U-profiles. The supporting pins 32 are connected to the U-profiles at predetermined intervals over the entire length of the climbing rail 18.

Via the connection piece 48 the first climbing rail extension piece 20 can be pushed into the free end of the climbing rail 18 and rigidly connected there to the climbing rail 18 with locking pins 50. The locking pins 50 can be secured by spring pins 51. Opposite the supporting pins 32, connecting pins 52 connect the U-profiles opposite each other. The connecting pins 52 can correspond to the supporting pins 32 and guarantee the same spacing of the U-profiles from one another as defined by the supporting pins 32.

Figure 4:
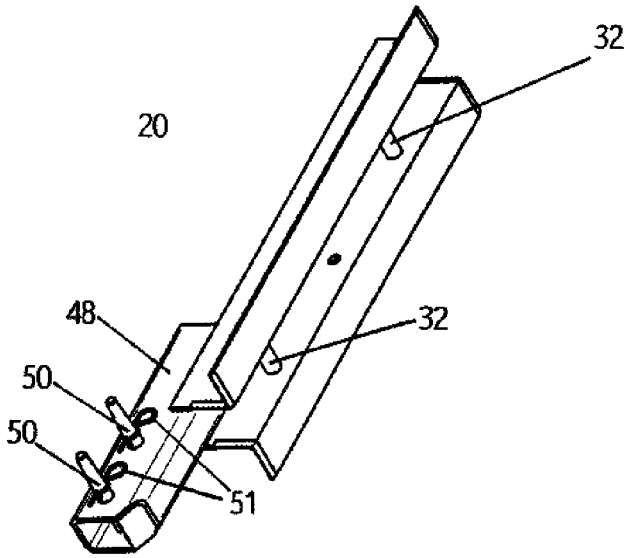
FIG. 4 shows a three-dimensional view of a climbing rail extension piece.

FIG. 4 shows a further three-dimensional view of the first climbing rail extension piece 20. Via the connection piece 48 it is connected to a climbing rail and via the locking pins 50 the first climbing rail extension piece 20 is rigidly connected to a climbing rail. The locking pins 50 are secured with the spring pins 51. The supporting pins 32 shown in the Figure can be engaged from below by catches on the climbing shoes and climbing cylinders, respectively.

Figure 5:
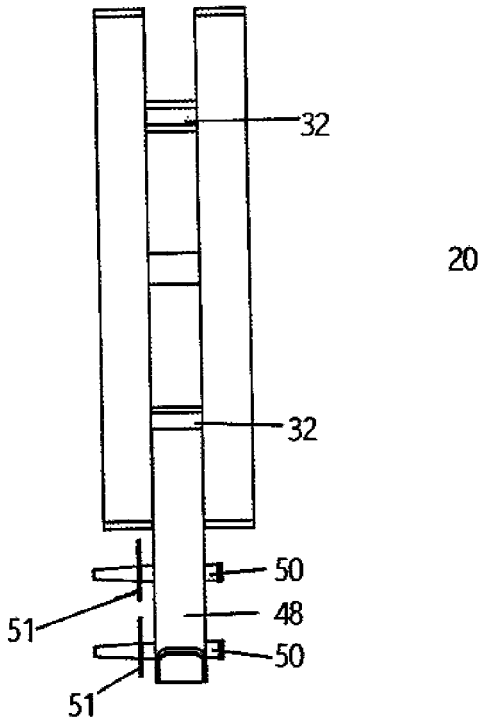
FIG. 5 shows a front view of a climbing rail extension piece in accordance with the invention.

FIG. 5 shows a front view of the first climbing rail extension piece 20. The supporting bolts 32 are visible and the locking bolts 50 are inserted on the connection piece 48 and secured with spring pins 51.

Figure 6:
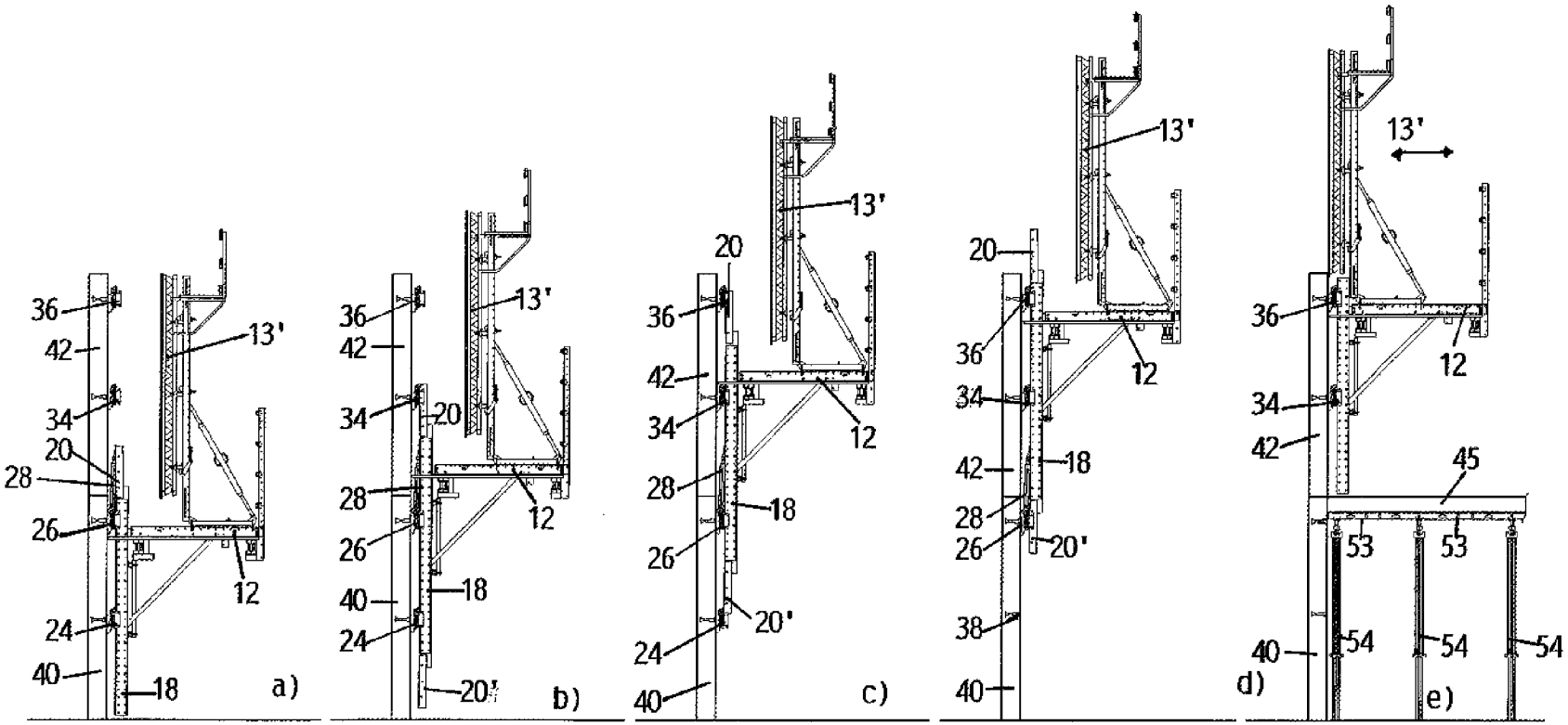
FIG. 6 shows a sequence of climbing procedures, divided into climbing sequences a) to e) with a rail-guided self-climbing formwork system in accordance with the invention, bearing an internal formwork on a working platform.

FIG. 6 shows a highly schematic view of the sequence of the climbing procedure with the rail-guided self-climbing formwork system. In diagram section a) two concrete sections 40 and 42 are shown. The first concrete section 40 has been produced with a known wall formwork, and after the first concrete section 40 has hardened, the climbing shoes 24 and 26 are mounted on the first concrete section 40. The climbing rail 18 is then inserted into the climbing shoes 24 and 26. In the process, the climbing shoes 24, 26 hold the climbing rail 18 and the scaffold unit connected therewith which, on working platform 12, holds an inner formwork 13' in a movable manner. With this inner formwork 13' concrete section 42 has been concreted and after hardening of concrete section 42 the inner formwork 13' has been moved into the shown position and the climbing shoes 34, 36 mounted. The first climbing rail extension piece 20 has also been mounted on climbing rail 18 and rigidly connected to climbing rail 18. A climbing cylinder 28 was mounted on the climbing shoe 26, which cylinder 28, when in the moved-in state, engages with the catch thereof a supporting pin of the first climbing rail extension piece 20.

If the climbing procedure is now started with the rail-guided self-climbing formwork system (diagram section b)) and the climbing cylinder 28 moved-out, after several cylinder strokes the free end of the first climbing rail extension piece 20 moves so far into the climbing shoe 34 until the catch of the climbing shoe 34 can support and engage a supporting pin of the first climbing rail extension piece 20. Alternatively, the climbing shoe 24, 26 can support the entire scaffold unit during a climbing procedure, while the climbing cylinder 28 is moved-in for a new climbing shoe. Generally, the weight of the entire self-climbing formwork system can be safely supported solely by the catches of the climbing shoe pairs 24 or 26 or 34. Safe guiding of the climbing rails 18 always takes place via two climbing shoe pairs arranged vertically above each other. The climbing cylinder 28 can then be moved-in and again brought into a new position in such a way that the catch of the climbing cylinder 28 can again engage a supporting pin of the first climbing-rail extension piece 20 or of climbing rail 18. If the climbing cylinder 28 is then moved-out again, the entire rail-guided self-climbing formwork system climbs further upwards. As soon as the climbing rail 18 has climbed so far up that a further climbing rail extension piece 20' can be mounted to the lower free end of the climbing rail 18, the climbing rail extension piece 20' is rigidly connected to the climbing rail 18, through being attached to the climbing rail 18 by means of securing pins, for example.

In the climbing position in diagram section c) the rail-guided self-climbing formwork system is held in the climbing shoes 26 and 34 via climbing rail 18 and the ends of the climbing rail extension pieces 20, 20' are still in the climbing shoes 24 and 36.

In diagram section d) the climbing sequence has progressed and the rail-guided self-climbing formwork system is in a position in which a third concrete section can be constructed. The climbing rail 18 is held via the climbing shoes 34 and 36 as catches of the climbing shoes 34, 36 engage below supporting pins of the climbing rail 18. The first climbing rail extension piece 20 can now be removed from the climbing rail 18 and the climbing rail extension piece 20' is also no longer required for guiding or securing the rail-guided self-climbing formwork system. The climbing cylinder 28 can also be removed from the climbing shoe 26. The climbing shoe 26 is also unbolted from the first concrete section 40.

In section e) the inner formwork 13' is shown moved to the concrete section 42 so that a third concrete section can be constructed above the second concrete section 42. At the same time it is possible to concrete a ceiling section 45 by means of a ceiling formwork 53 and ceiling props 54 used for this. It is understood that for the climbing sequence shown in FIG. 6 a rail-guided self-climbing formwork system is also used simultaneously for the external formwork. This is not shown for the sake of clarity.

Figure 7:
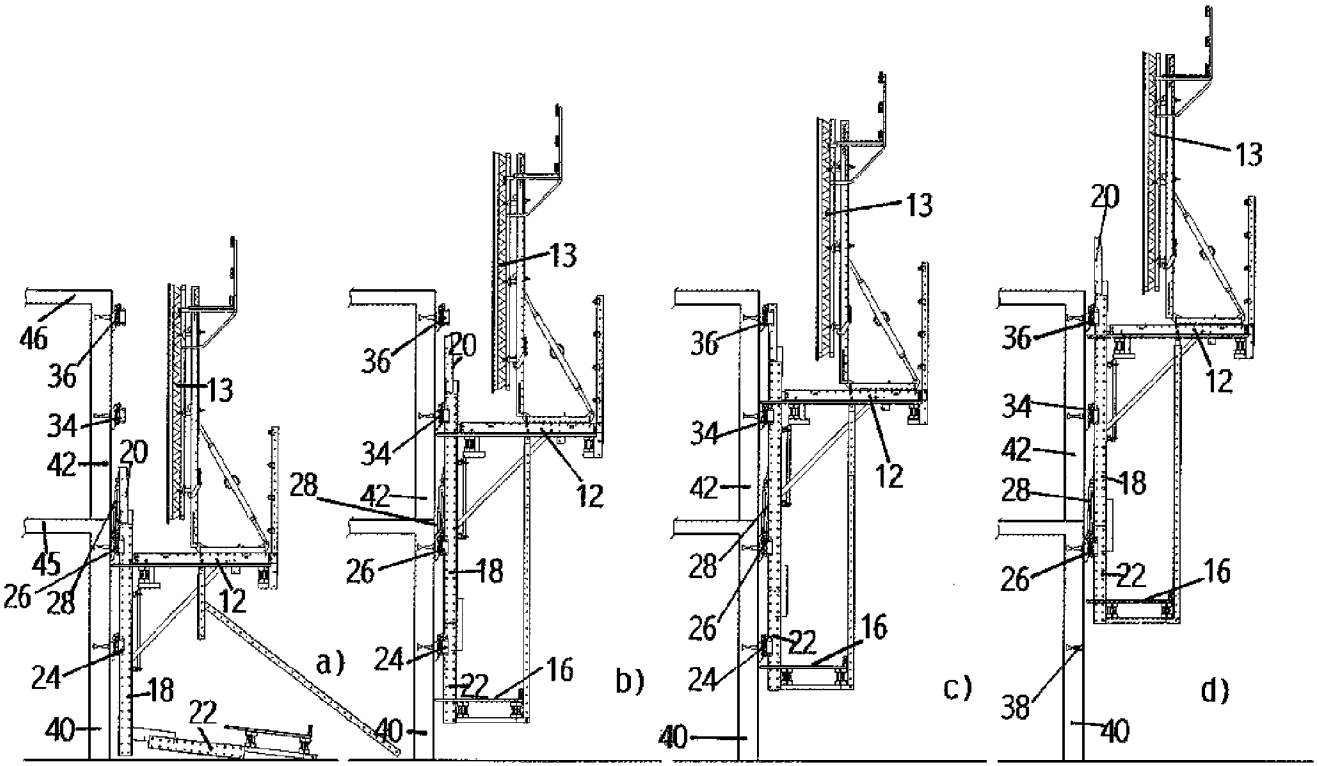
FIG. 7 shows a sequence of climbing procedures with a rail-guided self-climbing formwork system according to the invention in a climbing sequence a) to d) with a working platform bearing an external formwork and a scaffold unit also having a finishing platform.

FIG. 7 shows a side view of a climbing sequence in four sequences a) to d) as performed by a working platform 12 and an external formwork. The rail-guided self-climbing formwork system shown in FIG. 7 can be used as external formwork to construct the concrete sections, as shown in FIG. 6.

After in diagram a) the first concrete section 40 has been concreted with known wall formwork elements, the rail-guided self-climbing formwork system is fastened to the hardened first concrete section 40 by way of climbing shoes 24 and 26. The second concrete section 42 has also been produced with the external formwork 13. In FIG. 7 in diagram a) the external formwork 13 has already been moved away from the hardened second concrete section 42 and the climbing shoes 34 and 36 have already been attached to the hardened second concrete section. The first climbing rail extension piece 20 has been rigidly connected to the upper free end of the climbing rail 18 and on the lower free end of the climbing rail 18 a second climbing rail extension piece 22 is still held in an articulated manner on climbing rail 18. The second climbing rail extension piece 22 carries components of a finishing platform. If a climbing cylinder 28 is now mounted on climbing shoe 26 and the climbing procedure is initiated via the climbing cylinder 28, the entire rail-guided self-climbing formwork system moves upwards along the concrete sections 40, 42 and the finishing platform is automatically set up due to gravity. Via the working platform 12 and finishing platform 16 all work in the area of the rail-guided self-climbing formwork system can be carried out. In diagrams c) and d) the rail-guided self-climbing formwork system is moved further upwards until the external formwork 13 can be brought into position for a third concrete section. Via the working platform 12 the first climbing rail extension piece 20 can be removed and via the finishing platform 16 the climbing shoe 24 and climbing shoe 26, respectively, can be dismantled as required insofar as they are separable shoes.

In a rail-guided self-climbing formwork system 10 in the building sector, climbing rails 18 are guided in climbing shoes 24, 26, 34, 36, wherein the climbing rails are integrated into a scaffold unit. The scaffold unit also comprises a working platform 12 and a finishing platform 16 which are also attached to the climbing rails 18. Climbing rail extension pieces 20, 22 can be mounted on the free ends of the climbing rails 18 and rigidly attached there. The climbing rail extension pieces 20, 22 are shorter in length than the climbing rails 18.

I claim:

1. A method for constructing multi-story concrete structures using a rail-guided self-climbing formwork system, the concrete structures having a lower concrete section forming a vertical wall of a ground-floor story and at least one upper concrete structure extending vertically from an upper end of the first concrete structure, the method comprising the steps of:

a) attaching a first lower climbing shoe and a first upper climbing shoe to the lower concrete section;

b) disposing a climbing rail in a displaceable manner within the first lower and the first upper climbing shoes, the climbing rail having a length which is substantially equal to a height of the lower concrete section;

c) displacing the climbing rail in a vertical direction within the first lower and first upper climbing shoes;

d) positioning a lower extension piece to extend vertically in a downward direction below a lower end of the climbing rail and securing the lower extension piece to the climbing rail in that position, said lower extension piece having a length which is less than the length of the climbing rail; and e) further displacing the climbing rail in the vertical direction until the lower extension piece is captured within the first lower climbing shoe.

2. The method of claim 1, further comprising the steps of:

f) attaching a second lower climbing shoe and a second upper climbing shoe to the upper concrete section;

g) rigidly attaching an upper extension piece to an upper end of the climbing rail, the upper extension piece thereby extending in an upward vertical direction, the upper extension piece having a length which is less than the length of the climbing rail; and h) displacing the climbing rail in the vertical direction until the upper extension piece is captured, in a displaceable manner, within the second lower climbing shoe.

3. The method of claim 1, wherein the lower extension piece is attached to the lower end of the climbing rail in a pivoting manner prior to step c) and step d) comprises the step of pivoting the lower extension piece into a substantially vertical orientation.

4. The method of claim 1, wherein the length of the lower extension piece is greater than or equal to half a distance between the first lower and first upper climbing shoes.

5. The method of claim 2, wherein the lower and upper extension pieces are connected to the lower and upper ends of the climbing rail by means of locking pins.

6. The method of claim 5, wherein the lower and upper extension pieces are connected to the lower and upper ends of the climbing rail by means of two locking pins.

7. The method of claim 2, wherein the climbing rail, the lower extension piece and the upper extension piece each comprise two parallel profile rails which are held together at a separation from each other by means of supporting pins and/or spacers and connecting pins.

8. The method of claim 1, wherein the climbing rail is integral with a scaffold unit, the scaffold unit having a working platform and a finishing platform.

9. The method of claim 8, wherein the working platform is structured to support an external and internal formwork which can be moved on said working platform.

10. The method of claim 8, wherein the lower extension piece is structured to accept the finishing platform.

11. A concrete section with a rail-guided self-climbing formwork system in the building sector, the section comprising:

climbing shoes attached to a hardened concrete section;

climbing rails, guided in said climbing shoes, said climbing rails being integrated into a scaffold unit, each climbing rail being guided and held in a movable manner in multiple said climbing shoes, wherein each climbing rail has a length which is substantially equal to a height of the concrete section; and climbing rail extension pieces, said extension pieces being attached to free ends of said climbing rails, each extension piece having a length which is shorter than a length of said climbing rails, wherein said climbing rail extension pieces are attached to lower free ends of said climbing rails in a detachable and/or pivoting manner.

* * * * *

UNITED STATES PATENT AND TRADEMARK OFFICE

CERTIFICATE OF CORRECTION

PATENT NO. : 8,673,189 B2
APPLICATION NO. : 13/677337
DATED : March 18, 2014
INVENTOR(S) : Artur Schwoerer It is certified that error appears in the above-identified patent and that said Letters Patent is hereby corrected as shown below:

Please amend the Title Page of the patent to delete the first applicant as follows:

"(71) ~~Applicants: Reinhold Holzmueller, Stuttgart, (DE)"~~

Applicant: Peri GmbH, Weissenhorn (DE).

Signed and Sealed this
Fifteenth Day of July, 2014

Michelle K. Lee

Michelle K. Lee
*Deputy Director of the United States Patent and Trademark Office*